US007004013B2

(12) United States Patent
Kobayashi et al.

(10) Patent No.: US 7,004,013 B2
(45) Date of Patent: Feb. 28, 2006

(54) EVAPORATIVE EMISSION LEAK DETECTION SYSTEM WITH BRUSHLESS MOTOR

(75) Inventors: Mitsuyuki Kobayashi, Gamagori (JP); Yoshichika Yamada, Kuwana-gun (JP); Masao Kano, Gamagori (JP); Kenji Nagasaki, Nagoya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/459,440

(22) Filed: Jun. 12, 2003

(65) Prior Publication Data

US 2004/0000187 A1 Jan. 1, 2004

(30) Foreign Application Priority Data

Jun. 28, 2002 (JP) ..... 2002-189578

(51) Int. Cl.
*G01M 3/04* (2006.01)

(52) U.S. Cl. ..... 73/49.7

(58) Field of Classification Search ..... 73/40, 73/40.5 R, 49.7, 118.1; 123/518, 520, 519, 123/521; 702/51
See application file for complete search history.

(56) References Cited

U.S. PATENT DOCUMENTS

| | | | | |
|---|---|---|---|---|
| 4,881,507 A | | 11/1989 | San Filipo | 123/523 |
| 5,146,902 A | | 9/1992 | Cook et al. | 123/518 |
| 5,273,020 A | | 12/1993 | Hayami | |
| 5,349,935 A | | 9/1994 | Mezger et al. | |
| 5,635,630 A | | 6/1997 | Dawson et al. | |
| 5,730,107 A | | 3/1998 | Blumenstock | |
| 5,863,025 A | | 1/1999 | Noya | |
| 5,881,700 A | | 3/1999 | Gras et al. | |
| 5,890,474 A | | 4/1999 | Schnaibel et al. | 123/520 |
| 5,975,062 A | | 11/1999 | Bonse et al. | |
| 6,131,550 A | * | 10/2000 | Fritz et al. | 123/520 |
| 6,138,644 A | | 10/2000 | Saruwattari et al. | |
| 6,196,202 B1 | | 3/2001 | Busato et al. | |
| 6,247,458 B1 | | 6/2001 | Heinemann et al. | |
| 6,250,288 B1 | | 6/2001 | Fritz | 123/520 |
| 6,354,674 B1 | * | 3/2002 | Iwamoto et al. | 303/119.3 |
| 6,375,874 B1 | * | 4/2002 | Russell et al. | 264/28 |
| 6,412,277 B1 | | 7/2002 | Hagen et al. | |
| 2002/0121270 A1 | | 9/2002 | Kano et al. | 123/520 |

FOREIGN PATENT DOCUMENTS

JP 2001-336452 12/2001

* cited by examiner

*Primary Examiner*—Charles Garber
(74) *Attorney, Agent, or Firm*—Nixon & Vanderhye P.C.

(57) ABSTRACT

An evaporative emission leak detection system provides for detecting a leakage of a fuel vapor evaporating in a fuel tank by using a pressure difference between an inside and outside of the fuel tank. The system includes a pump for providing the pressure difference between the inside and outside of the fuel tank, a brushless motor for operating the pump, a first passage connecting to the fuel tank, a second passage connecting to the outside of the fuel tank, and a switching device for switching connections between the pump and at least one of the first passage and the second passage. The first passage has an adsorbent for adsorbing the fuel vapor. This system ensures a long life time and high accuracy of the leak detection.

31 Claims, 6 Drawing Sheets

| STEP | BRUSHLESS MOTOR | PRESSURE SENSOR | SWITCHING DEVICE |
|---|---|---|---|
| A | OFF | ON | OFF |
| B | OFF | ON | ON |
| C | ON | ON | OFF |
| D | ON | ON | ON |
| E | OFF | ON | OFF |

EVAPORATIVE EMISSION LEAK DETECTION SYSTEM WITH BRUSHLESS MOTOR

CROSS REFERENCE TO RELATED APPLICATION

This application is based on Japanese Patent Application No. 2002-189578 filed on Jun. 28, 2002, the disclosure of which is incorporated herein by reference.

FIELD OF THE INVENTION

The present invention relates to an evaporative emission leak detection system for detecting leakage of fuel vapor leaking outside a fuel system. This leak detection system is suitably applied to a fuel system, which is mounted on an automotive vehicle.

BACKGROUND OF THE INVENTION

Recently, in addition to an automotive vehicle discharge emission regulation, it is required to regulate an evaporative fuel emission. For example, the California Air Resources Board (i.e., CARB) as well as the U.S. Environmental Protection Agency (i.e., EPA) require detection of evaporative emission leakage from a small opening of a fuel tank of an automotive vehicle.

In view of detecting an evaporative emission leakage, U.S. Pat. No. 5,146,902 (JP-A-5-272417) and U.S. Pat. No. 5,890,474 (JP-A-10-90107) disclose evaporative emission leak detection systems for detecting leakage of fuel vapor leaking outside a fuel tank. These prior arts utilize a pressure difference between an inside and outside of the fuel tank. The pressure difference is provided by increasing or decreasing the pressure of the fuel tank with a pump. When leakage exists, a pumping load of the pump changes in accordance with size of leakage opening. Therefore, the evaporative emission leakage can be estimated by measuring the pumping load change.

However, when the pump increases the pressure of the fuel tank, i.e., the pump pressurizes the fuel tank, the fuel vapor is released outside the fuel tank at every detection time. Further, when the pump decreases the pressure of the fuel tank, i.e., the pump depressurizes the fuel tank, the fuel vapor may be eliminated by a canister. However, the residual fuel vapor, which is not eliminated by the canister, penetrates into the pump. When the pump is driven by a brush motor, the residual fuel vapor adheres to a sliding portion of the pump, for example, a sliding portion of a brush. Therefore, the sliding portion will be abraded. Moreover, abraded powder of the sliding portion adheres to a commutator of the motor, so that the commutator will be abnormally abraded. Thus, the motor operation becomes unstable and a life time of the motor decreases. Further, operation characteristics of the motor deteriorate with age because of an abrasion of the brush and the commutator, so that the leak detection system does not detect leakage accurately.

SUMMARY OF THE INVENTION

In view of the above problems, it is an object of the present invention to provide an evaporative emission leak detection system, which ensures a long life time and high accuracy of the leak detection.

An evaporative emission leak detection system provides for detecting leakage of fuel vapor evaporating in a fuel tank by using a pressure difference between an inside and outside of the fuel tank. The system includes a pump for providing the pressure difference between the inside and outside of the fuel tank, a brushless motor for operating the pump, a first passage connecting to the fuel tank, a second passage connecting to the outside of the fuel tank, and a switching device for switching connections between the pump and at least one of the first passage and the second passage. The first passage has an adsorbent for adsorbing the fuel vapor.

The brushless motor has no mechanical contact portion so that the brushless motor does not have a sliding portion such as a commutator and a brush. Therefore, the brushless motor is not abraded by penetration of the fuel vapor into the brushless motor. Thus, the life time of the brushless motor is lengthened, and the brushless motor operates stably. Further, operation characteristics of the brushless motor do not deteriorate with age substantially, so that current supplied to the brushless motor is stabilized. Therefore, the operation of the pump can be stabilized. Moreover, the brushless motor does not generate a noise substantially. Therefore, the accuracy of the evaporative emission leak detection is improved.

Preferably, the system includes a throttle disposed between the second passage and the pump, and a detecting device for detecting a pressure. The pump depressurizes the fuel tank at least below the atmospheric pressure. The throttle throttles air flow to a predetermined amount so that the pressure in a passage between the pump and the switching device is decreased to a predetermined pressure and is regulated to the predetermined pressure when the first and second passages connect to the pump only through the throttle and the pump depressurizes the passage. The detecting device is disposed in the passage between the pump and the switching device, and detects the atmospheric pressure, the fuel vapor pressure, and the predetermined pressure.

In this case, the system detects the pressure of the fuel vapor evaporating from the fuel tank, so that the system can detect the evaporative emission leakage without influence of the atmospheric pressure, the altitude, the humidity, and other environmental conditions. Therefore, the detection accuracy of the leakage is improved. Moreover, the concentration of the fuel vapor in the fuel tank, the humidity, the atmospheric pressure, and other environmental conditions always change, as time passes. Therefore, the evaporative emission leakage changes, so that the detection accuracy of the leakage may change. However, the atmospheric pressure, the fuel vapor pressure, and the predetermined pressure are measured at every detection time so that the detection accuracy of the leakage preserves.

The detection device directly detects the pressure in the passage that connects to the fuel tank. Therefore, the detection accuracy of the evaporative emission leakage is higher than that in a case where the pressure of the fuel tank is calculated indirectly by measuring the current of the motor.

Further, the fuel tank is depressurized so as to detect the evaporative emission leakage. Therefore, the fuel vapor is not released outside the fuel tank, so that the environmental protection can be achieved.

Preferably, the system includes a microcomputer for controlling the switching device, the detecting device, the brushless motor, and the like. The pressure in the passage between the pump and the switching device is decreased to a leak detection pressure when the first passage connects to the pump and the pump depressurizes the passage between the pump and the switching device. The microcomputer determines that the leakage of the fuel vapor exceeds the predetermined amount of the air flow limited by the throttle when the leak detection pressure becomes larger than the predetermined pressure.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT (First Embodiment)

Figure 1:
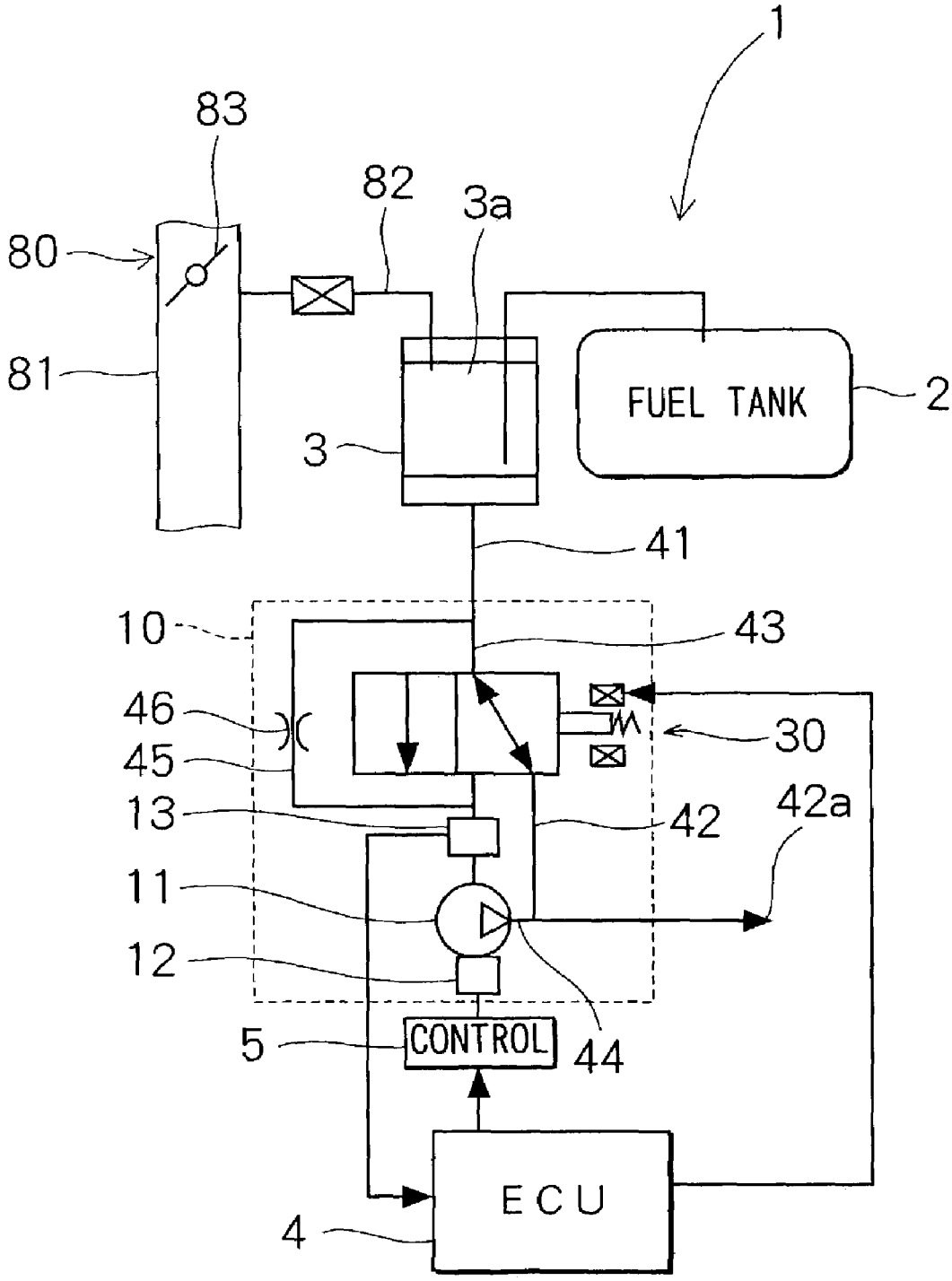
FIG. 1 is a schematic diagram showing an evaporative emission leak detection system according to the first embodiment of the present invention.
Figure 2:
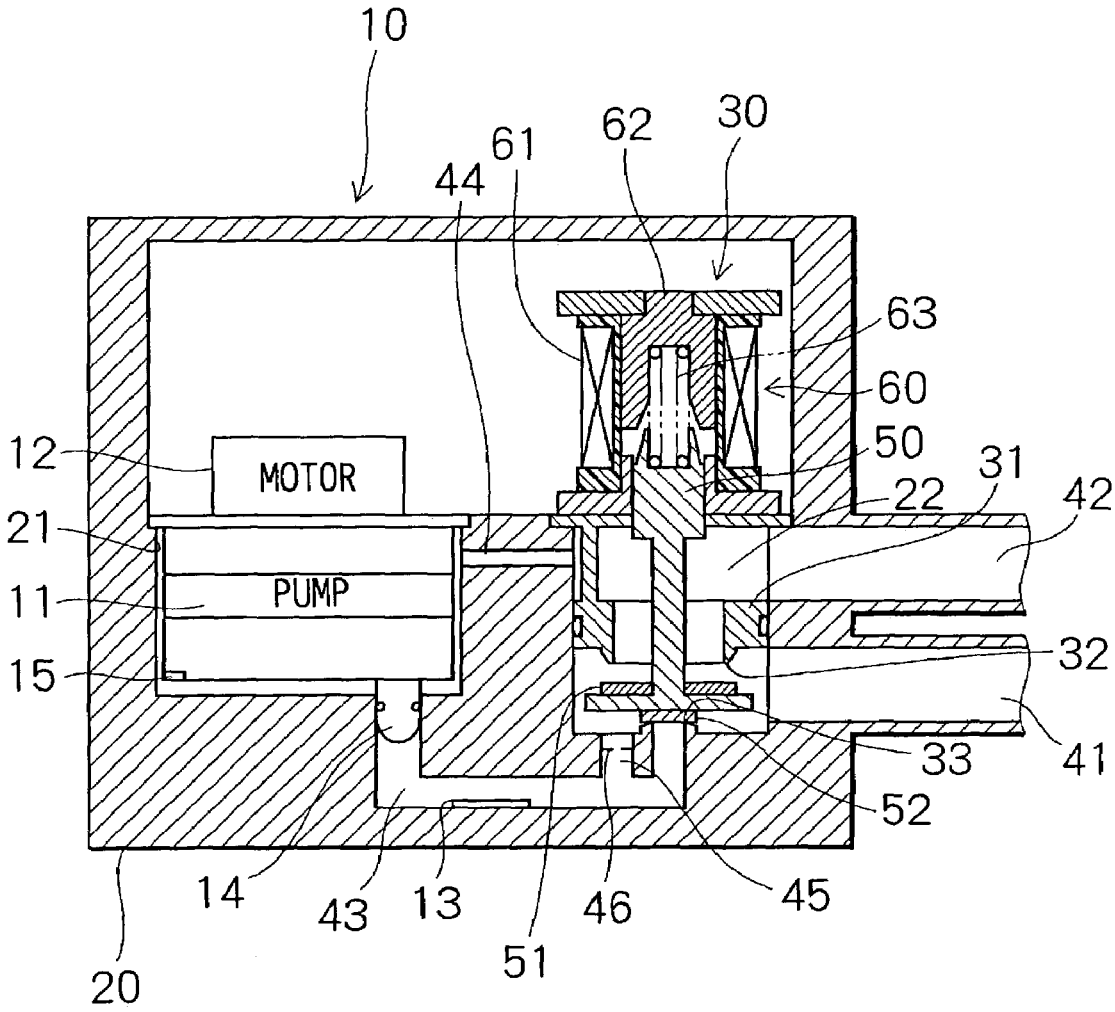
FIG. 2 is a cross-sectional view showing a detection module according to the first embodiment when a coil of the detection module is not energized.

An evaporative emission leak detection system 1 according to the first embodiment of the present invention is applied to a fuel system of an automotive vehicle, as shown in FIG. 1. The detection system 1 includes a detection module 10, a fuel tank 2, a canister 3 as an adsorber, air intake equipment 80, and ECU 4 (i.e., electric control unit). The detection module 10 has, as shown in FIG. 2, a housing 20, a pump 11, a brushless motor 12, a switching device 30, and a pressure sensor 13. The detection module 10 is disposed at the higher position than the fuel tank 2 and the canister 3, so that fuel and water leaking from the fuel tank 2 and the canister 3 do not penetrate into the detection module 10.

The housing 20 includes a pump chamber 21 for accommodating the pump 11, and a valve chamber 22 for accommodating the switching device 30. The housing 20 also accommodates the brushless motor 12. The housing 20 also includes a tank passage 41 as a first passage, an open passage 42 as a second passage, a connection passage 43, and a discharge passage 44. The open passage 42 has an opening 42*a*, which opens to the atmosphere outside the detection system 1, as shown in FIGS. 1 and 2. The open passage 42 connects the opening 42*a* to the valve chamber 22 of the housing 20. The connection passage 43 connects the valve chamber 22 to the pump 11. The valve chamber 22 of the housing 20 connects to the fuel tank 2 through the tank passage 41 and the canister 3. Therefore, the air including the fuel vapor flows from the fuel tank 2 to the pump 11 through the tank passage 41 and the connection passage 43. Further the air flows from the opening 42*a* to the pump 11 through the open passage 42, the valve chamber 22, and the connection passage 43. Here, the air flowing through the connection passage 43 is described as a mixed gas, infra.

The discharge passage 44 connects the pump chamber 21 to the open passage 42 through the valve chamber 22. Thus, the mixed gas is discharged from the pump 11 to the outside of the fuel tank 2 through the discharge passage 44. The connection passage 43 branches to an orifice passage 45 at the side of the valve chamber 22. The orifice passage 45 connects the connection passage 43 to the valve chamber 22, and includes an orifice 46 as a throttle. The orifice 46 flows the air at a predetermined amount that is equal to an amount of the air flowing from a permissible opening, which is a maximum leakage opening required by the governmental regulations. For example, the CARB as well as the EPA requires the detection of a leakage opening of $\phi$0.5 mm. In this embodiment, the orifice 46 provides an air flow corresponding to the leakage opening at $\phi$0.5 mm and less.

The pump 11 is accommodated in the pump chamber 21, and includes a suction port 14 and a discharge port 15. The suction port 14 is disposed in the connection passage 43, and the discharge port 15 is disposed in the pump chamber 21. The pump 11 is driven by the brushless motor 12, so that the pump 11 sucks the mixed gas in the connection passage 43 through the suction port 14. Then, the pressure of the mixed gas in the connection passage 43 is decreased, i.e., the connection passage is depressurized. The brushless motor 12 is a contact less direct current motor, which has no contact portion mechanically and rotates a moving portion (not show) by changing a position for energizing a coil of the motor 12. The brushless motor 12 is controlled by the controller 5.

The switching device 30 includes a valve body 31, a valve member 50, and an electromagnetic unit 60. The valve body 31 is accommodated in the valve chamber 22 of the housing 20. The valve body 31 has a first valve seat 32, which is disposed on the side of the tank passage 41. A washer 51 is mounted on the valve member 50, and can be press-contacted to the first valve seat 32. The valve member 50 is driven by the electromagnetic unit 60. The electromagnetic unit 60 has a coil 61, which electrically connects to the ECU 4.

The valve member 50 includes a contact pad 52 for press-contacting a second valve seat 33. The contact pad 52 is disposed on an end of the valve member 50, which is opposite to the electromagnetic unit 60. The second valve seat 33 is disposed on an end of the connection passage 43, and is disposed in the valve chamber 22. Normally, i.e., when the coil 61 is not energized, a force by a spring 63 is applied to the valve member 50 so that the valve member 50 moves toward the second valve seat 33. When the valve member 50 moves toward the second valve seat 33, the contact pad 52 contacts the second valve seat 33.

Thus, the contact pad 52 is press-contacted to the second valve seat 33, as shown in FIG. 2. Therefore, the tank passage 41 and the open passage 42 are connected together, and both the tank passage 41 and the open passage 42 are connected to the connection passage 43 only through the orifice passage 45.

Figures 3, 4:
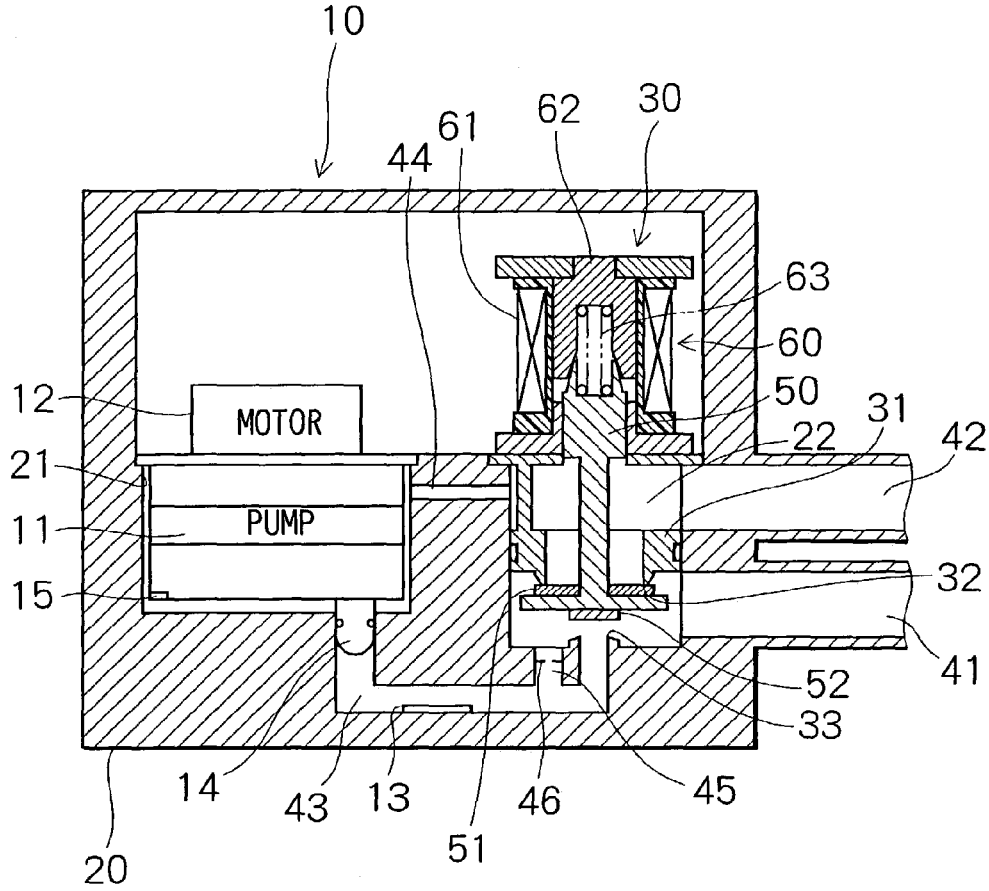
FIG. 3 is a cross-sectional view showing the detection module according to the first embodiment when the coil of the detection module is energized.
FIG. 4 is a table showing steps for detecting an evaporative emission leakage, according to the first embodiment.

When the coil 61 is energized, a core 62 of the electromagnetic unit 60 is magnetized. The core 62 attracts the valve member 50 so that the valve member 50 moves toward the first valve seat 32. When the valve member 50 moves toward the first valve seat 32, the washer 51 contacts the first valve seat 32. Thus, the washer 51 is press-contacted to the first valve seat 32, as shown in FIG. 3. Therefore, the tank passage 41 and the open passage 42 are disconnected, and the tank passage 41 and the connection passage 43 are connected, as shown in FIG. 3.

When the washer 51 of the valve member 50 is press-contacted to the first valve seat 32 as shown in FIG. 3, electric power supplied to the coil 61 is smaller than that in a case where the valve member 50 is just moving toward the first valve seat 32. In other words, a holding electric power for holding the press-contact between the washer 51 and the first valve seat 32 is comparatively small. Therefore, the holding electric power can be limited to be small to such an extent that the washer 51 is press-contacted to the first valve seat 32 and the valve member 50 does not move. For example, the holding electric power is supplied to the coil 61 intermittently by a pulse-modulated voltage or the like. Thus, the electric power supplied to the coil 61 can be reduced, so that heat generated by the coil 61 is also reduced. Therefore, the change of detection accuracy according to the heat can be reduced.

As shown in FIG. 1, the canister 3 has an adsorbent 3*a*. The adsorbent 3*a* is, for example, an active carbon, and adsorbs the fuel vapor evaporating from the fuel tank 2. The canister 3 is disposed in the tank passage 41 between the valve chamber 22 and the fuel tank 2. A purge passage 82 connects to the canister 3, and connects to an air intake duct 81 of the air intake equipment 80. The fuel vapor is adsorbed by the adsorbent 3*a* in the canister 3. After passing through the canister 3, the mixed gas flowing from the canister 3 contains a small concentration of the fuel vapor, the concentration of which is smaller than a predetermined amount. Here, the air intake equipment 80 includes the air intake duct 81, which connects to the air intake of the engine, and a throttle valve 83 for adjusting the intake air flowing through the air intake duct 81.

The pressure sensor 13 is disposed in the connection passage 43. The pressure sensor 13 detects pressure of the air in the connection passage 43, and outputs a signal corresponding to the pressure. The ECU 4 receives the signal from the pressure sensor 13. The ECU 4 includes a microcomputer that is composed of a central processing unit (i.e., CPU), a read only memory (i.e., ROM), and a random-access memory (i.e., RAM). The ECU 4 controls the whole engine system and the detection module 10. For example, the ECU 4 controls the controller 5 and the switching device 30. A plurality of signals is output from several sensors that are disposed on the vehicle, especially on the engine system such as the pressure sensor 13, so that these signals are input into the ECU 4. The ECU 4 receives these signals so that the ECU 4 controls the whole engine system according to a predetermined control program memorized in the ROM of the ECU 4.

The detection module 10 in the evaporative emission leak detection system 1 operates as follows.

When a predetermined time has passed since the engine of the vehicle stopped, the evaporative emission leak detection system 1 begins to operate. This predetermined time is set to a period in which the temperature of the whole engine system is stabilized.

The evaporative emission leakage from the fuel tank 2 is detected on the basis of the pressure change. Therefore, an influence rising from a deviation of the atmospheric pressure PA at each altitude should be compensated. Therefore, at first, the atmospheric pressure PA is measured by the pressure sensor 13, which is disposed in the connection passage 43. When the coil 61 is not energized, as shown in FIG. 2, the open passage 42 connects to the connection passage 43 through the orifice passage 45, so that the pressure in the connection passage 43 is almost equal to the atmospheric pressure PA. The pressure sensor 13 measures the pressure of the air in the connection passage 43, i.e., the atmospheric pressure PA, and outputs a pressure signal corresponding to the measured pressure.

Here, the pressure signal is output as a voltage ratio signal, a duty ratio signal, or a bit output signal so that the pressure signal is not affected by an electromagnetic noise rising from the electrical driving portion such as the electromagnetic unit 60 and the like. Thus, the pressure sensor 13 preserves its accuracy of the detection. The pressure sensor 13 substantially measures the atmospheric pressure PA near the detection module 10, so that the accuracy of the detection using the pressure sensor 13 is higher than that using another atmospheric sensor, for example, mounted on the fuel injection device, which is far from the detection module 10.

Figure 5:
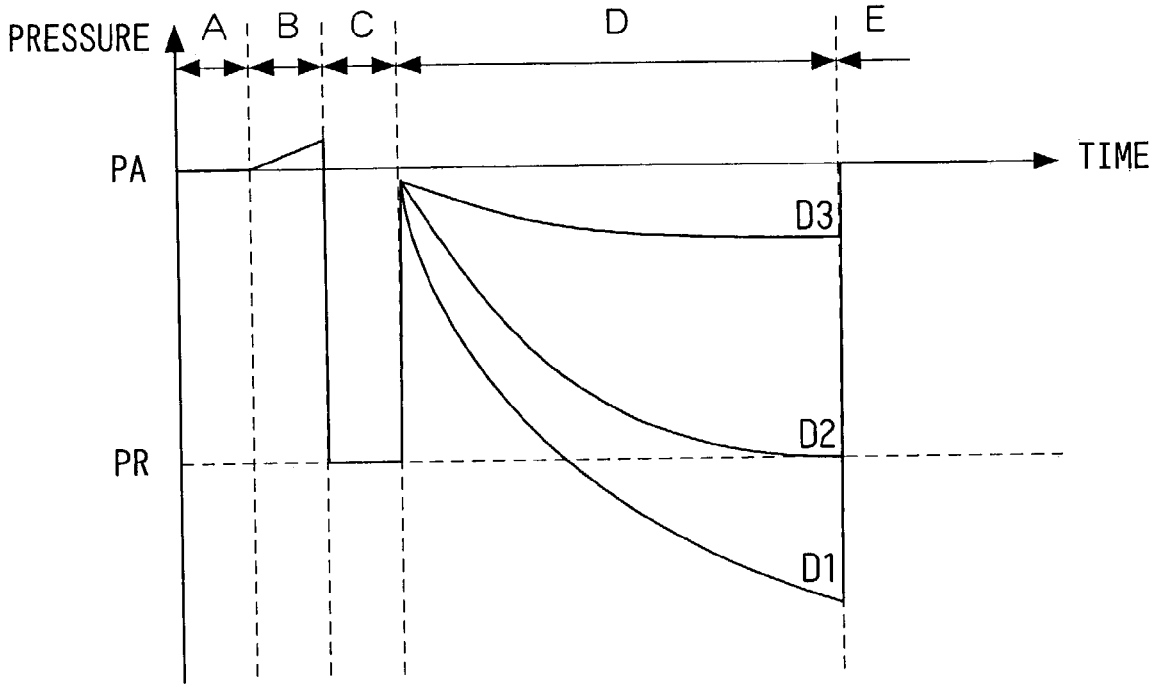
FIG. 5 is a timing chart showing pressure of a connection passage, according to the first embodiment.

During the above measurement, as shown by step A in FIGS. 4 and 5, only the pressure sensor 13 operates, and both the brushless motor 12 and the switching device 30 stop to operate. Here, step A is defined as an atmospheric pressure detection step.

Then, the altitude of the vehicle having the evaporative emission leak detection system 1 is calculated by using the measured atmospheric pressure PA. For example, the altitude is calculated by using a relationship between the atmospheric pressure PA and the altitude, which is memorized in the ROM of the ECU 4. According to the calculated altitude, several parameters for detecting the evaporative emission leakage are compensated and corrected. These compensations and corrections are performed by the ECU 4.

Next, the switching device 30 is operated, i.e., the coil 61 of the switching device 30 is energized, as shown by step B in FIGS. 4 and 5. Step B is defined as a fuel vapor detection step. When the coil 61 is energized, the valve member 50 is attracted to the core 62 so that the washer 51 is press-contacted to the first valve seat 31. Thus, the open passage 42 and the connection passage 43 are disconnected, and the tank passage 41 and the connection passage 43 are connected. Therefore, the fuel tank 2 and the connection passage 43 are connected through the tank passage 41. When the fuel in the fuel tank 2 evaporates so that the fuel vapor rises, the inner pressure of the fuel tank 2 becomes higher than the atmospheric pressure PA outside the fuel tank 2. In this case, the pressure of the connection passage 43 increases. The pressure sensor 13 detects this increase of the pressure, so that the pressure of the fuel vapor can be detected.

After the pressure sensor 13 detects the pressure increase, the coil 61 stops to be energized, as shown by step C in FIGS. 4 and 5. Step C is defined as a reference pressure detection step. The valve member 50 moves toward the second valve seat 33, so that the contact pad 52 is press-contacted to the second valve seat 33. Thus, the tank passage 41 connects to the open passage 42, and both the tank passage 41 and the open passage 42 are connected to the connection passage 43 only through the orifice passage 45.

Then, the brushless motor 12 is energized so as to operate the pump 11 for depressurizing the mixed gas in the connection passage 43. The air in the open passage 42 and the mixed gas in the tank passage 41 flow into the connection passage 43 through the orifice passage 45, and are pumped by the pump 11 so that the pressure in the connection passage 43 is decreased as shown by step C in FIG. 5. However, the orifice 46 in the orifice passage 45 throttles a flow of the mixed gas flowing into the connection passage 43, so that the pressure in the connection passage 43 is decreased to a predetermined pressure, i.e., a depressurizing reference pressure PR. Thus, the pressure in the connection passage 43 is stabilized at the depressurizing reference pressure PR, so that the pressure sensor 13 detects the depressurizing reference pressure PR, and outputs a pressure signal to the ECU 4.

Then, the coil 61 of the switching device 30 is energized again, as shown by step D in FIGS. 4 and 5. In step D, the washer 51 is press-contacted to the first valve seat 32, the tank passage 41 and the connection passage 43 are connected together, and the open passage 42 and the connection passage 43 are disconnected. Therefore, the fuel tank 2 connects to the connection passage 43 through the tank passage 41, so that the pressure of the fuel tank 2 is equal to the pressure of the connection passage 43. Thus, the pressure of the connection passage 43 increases rapidly and temporarily.

Then, the brushless motor 12 is energized to operate the pump 11 so that the pressure of the mixed gas in the fuel tank 2 is decreased through the tank passage and the connection passage, i.e., the fuel tank is depressurized. The controller 5 controls the brushless motor 12 so as to regulate a rotation speed of the brushless motor 12. Therefore, even when a pressure difference between the inside and outside of the fuel tank 2 is comparatively small, the detection system 1 can detects the evaporative emission leakage.

Here, because the fuel tank 2 connects to the connection passage 43, the pressure sensor 13 detects the pressure of the connection passage 43 that is equal to the pressure of the fuel tank 2. When the detected pressure of the connection passage 43, i.e., the pressure of the fuel tank 2, is decreased below the depressurizing reference pressure PR, it is determined that the evaporative emission leakage from the fuel tank 2 is below the allowable amount, as shown by D1 in FIG. 5. This means that the outside air outside the fuel tank 2 does not penetrate into the fuel tank 2, so that the fuel tank 2 is airtight sufficiently. Reversely, the fuel vapor rising in the fuel tank 2 does not leak outside the fuel tank 2 substantially, and the evaporative emission leakage is below the allowable amount.

When the detected pressure of the connection passage 43 is almost equal to the depressurizing reference pressure PR, the evaporative emission leakage leaking from the fuel tank 2 corresponds to a leakage from the orifice 46, as shown by D2 in FIG. 5.

On the other hand, when the detected pressure of the connection passage 43 is not decreased below the depressurizing reference pressure PR, it is determined that the evaporative emission leakage exceeds the allowable amount, as shown by D3 in FIG. 5. In this case, the outside air outside the fuel tank 2 penetrates into the fuel tank 2, as the fuel tank 2 is depressurized. Reversely, it is considered that the fuel vapor evaporating in the fuel tank 2 leaks outside the fuel tank 2.

When the evaporative emission leakage is determined to exceed the allowable amount, a warning lamp (not shown) mounted on the instrument panel turns on when the engine starts at next time. A driver of the vehicle recognizes the warning lamp and is informed about the evaporative emission leakage.

After that, both the brushless motor 12 and the switching device 30 stop to be energized, as shown by step E in FIGS. 4 and 5. Step E is defined as a detection completion step. The pressure of the connection passage 43 recovers to the atmospheric pressure PA. The pressure sensor 13 detects the atmospheric pressure PA and outputs the pressure signal to the ECU 4. Then, the ECU 4 controls the pressure sensor 13 to stop its operation. Then, the evaporation emission leak detection is completed.

In the detection module 10, the brushless motor 12 is used for operating the pump 11. The brushless motor 12 has no mechanical contact portion so that the brushless motor 12 does not have a sliding portion such as a commutator and a brush. Therefore, even when the mixed gas rising from the fuel tank 2 penetrates into the pump 11 or the brushless motor 12, the brushless motor 12 is not abraded, and has no abraded powder. Thus, the life time of the brushless motor 12 is lengthened, and the brushless motor 12 operates stably. Further, operation characteristics of the brushless motor 12 do not deteriorate with age substantially, so that current supplied to the brushless motor 12 is stabilized. Therefore, the operation of the pump 11 can be stabilized.

Moreover, the brushless motor 12 does not generate a noise substantially, because the brushless motor 12 has no contact portion. Further, the brushless motor 12 is controlled by the controller 5 with a constant voltage control. Therefore, the operation of the brushless motor 12 is stable, and also the operation of the pump 11 driven by the brushless motor 12 can be stabilized. Thus, the accuracy of the evaporative emission leak detection by the pressure sensor 13 is improved.

Further, the brushless motor 12 and the pump 11 are disposed in space, which is filled with the fuel vapor. Therefore, the brushless motor 12 needs no rotation shaft sealing so that the structure of the brushless motor 12 is simplified. If the brushless motor 12 is disposed outside the space, which filled with the fuel vapor, the brushless motor 12 necessitates a rotation shaft sealing for preventing the fuel vapor from leaking.

In this embodiment, the pressure of the mixed gas, which flows through the orifice 46 of the orifice passage 45, is measured, before the fuel tank 2 is depressurized. Therefore, the evaporative emission leak detection system 1 detects the pressure of the fuel vapor evaporating from the fuel tank 2, so that the detection system 1 can detect the evaporative emission leakage without influence of the atmospheric pressure PA, the altitude of the vehicle, the humidity, and other environmental conditions. Therefore, the detection accuracy of the leakage is improved.

In general, the concentration of the fuel vapor in the fuel tank 2, the humidity, the atmospheric pressure PA, and other environmental conditions always change, as time passes. Therefore, the evaporative emission leakage changes, so that the detection accuracy of the leakage may change. However, in this embodiment, the reference pressure is measured at every detection time so that the detection accuracy of the leakage preserves.

The pressure sensor 13 directly detects the pressure of the connection passage 43 that connects to the fuel tank 2. Therefore, the detection accuracy of the evaporative emission leakage is higher than that in a case where the pressure of the fuel tank 2 is calculated indirectly by measuring the current of the motor.

In steps C and D, the fuel tank 2 is depressurized so as to detect the evaporative emission leakage. Therefore, the mixed gas including the fuel vapor is not released outside the fuel tank 2, so that the environmental protection can be achieved.

(Second Embodiment)

Figure 6:
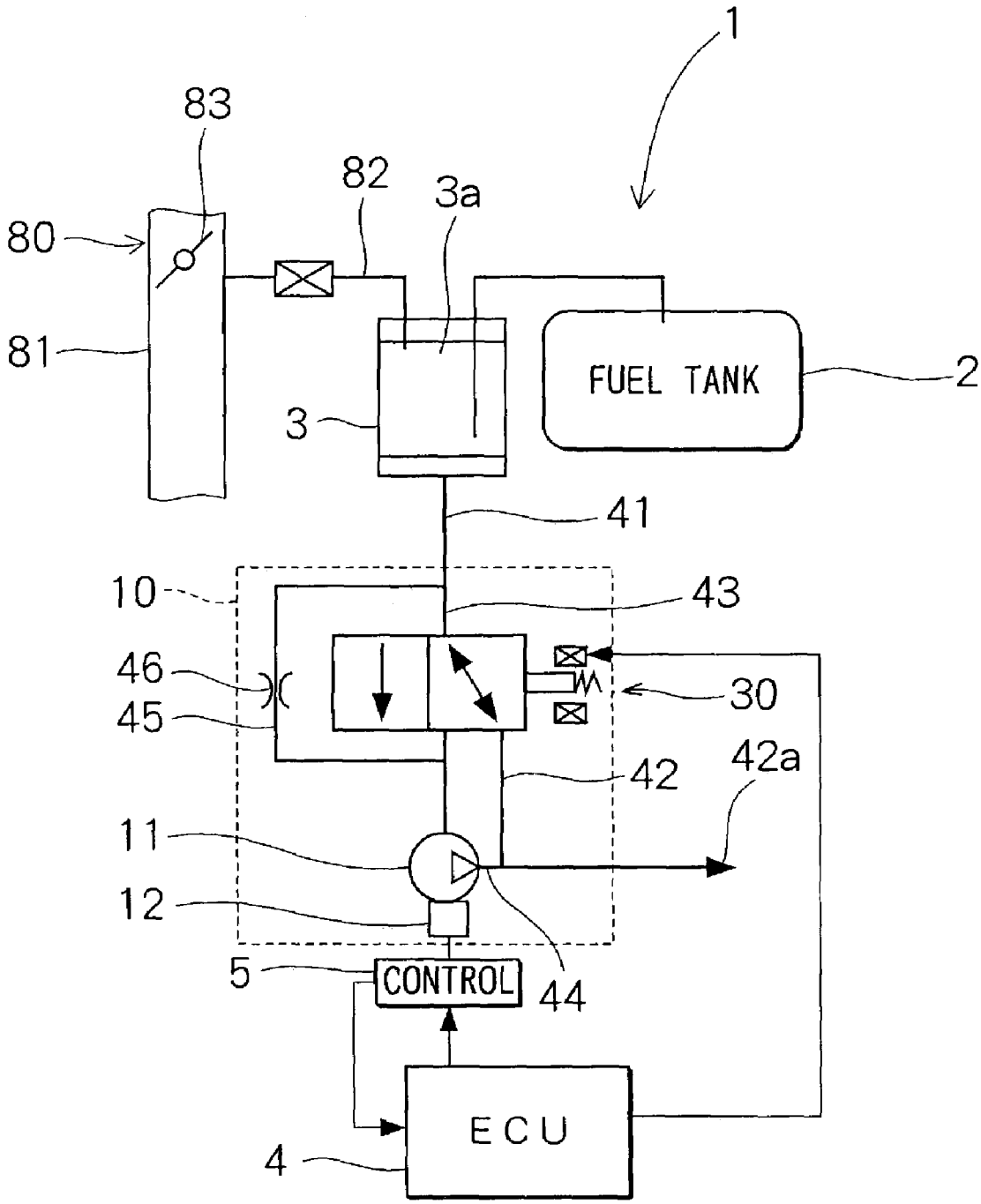
FIG. 6 is a schematic diagram showing an evaporative emission leak detection system according to the second embodiment of the present invention.

According to a second embodiment, as shown in FIG. 6, the detection module 10 has no pressure sensor. Therefore, the ECU 4 gets the information about operation characteristics of the brushless motor 12 from the controller 5. Here, the operation characteristics are, for example, voltage and current supplied to the brushless motor 12, and rotation speed of the brushless motor 12. Here, the brushless motor 12 is controlled with constant voltage control, and the brushless motor 12 operates stably in each current supplied to the brushless motor 12. Therefore, the operation characteristics of the brushless motor 12 can be detected accurately by measuring the current.

Figure 7:
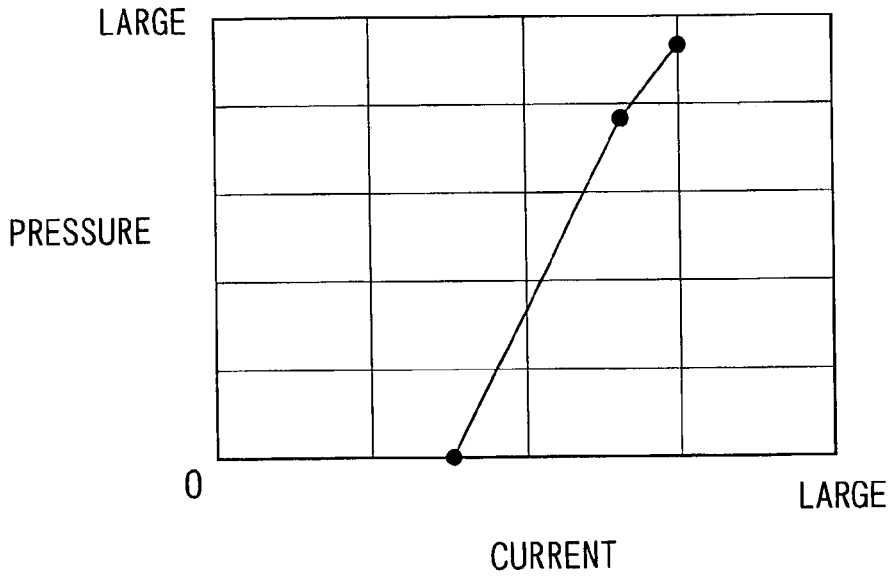
FIG. 7 is a graph showing a relationship between pressure of a connection passage and current of a brushless motor, according to the second embodiment.
Figure 8:
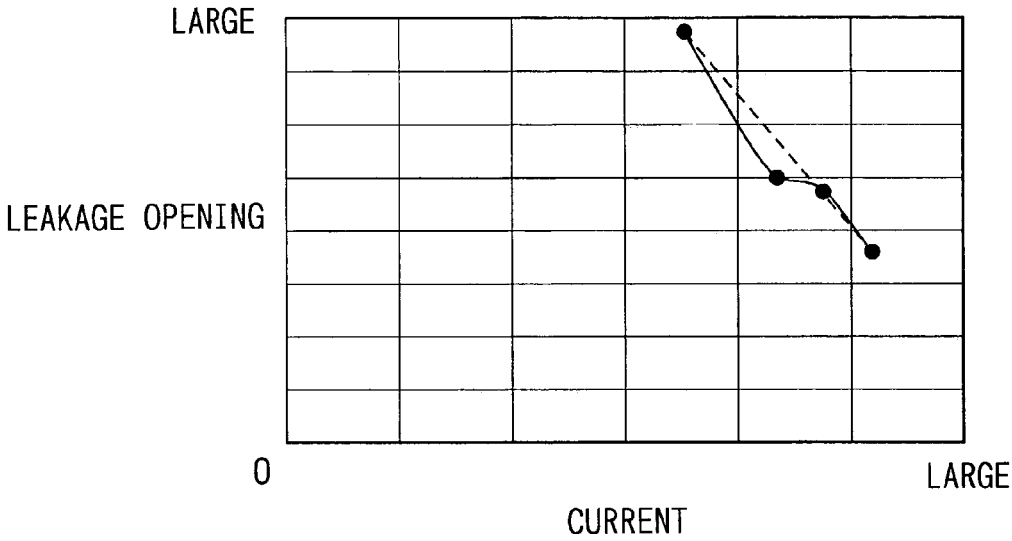
FIG. 8 is a graph showing a relationship between size of a leakage opening and current of the brushless motor, according to the second embodiment.

For example, the current supplied to the brushless motor 12 relates to the inner pressure of the fuel tank 2, as shown in FIG. 7. Also as shown in FIG. 8, the current supplied to the brushless motor 12 relates to a leakage opening, i.e., a size of leakage opening. The fuel vapor leaks through this leakage opening.

Thus, the ECU 4 gets the information about the operation characteristics of the brushless motor 12 from the controller 5, so that the inner pressure of the fuel tank 2 as well as the size of the leakage opening can be calculated. Further, the pressure of the connection passage 43 can be obtained indirectly by measuring the operation characteristics of the brushless motor 12 without the pressure sensor.

In general, the controller 5 includes the detection means of the operation characteristics of the brushless motor 12. In other words, the controller 5 can be used as a load detection device for measuring the operation characteristics, so that no additional circuit is necessitated.

In this embodiment, because the evaporative emission leak detection system 1 has no pressure sensor, the atmospheric pressure PA is obtained by another pressure sensor mounted on other equipment of the vehicle such as fuel injection equipment and air intake equipment.

(Third Embodiment)

Evaporative emission leak detection system according to the third embodiment is a modification of the first embodiment.

Figure 9:
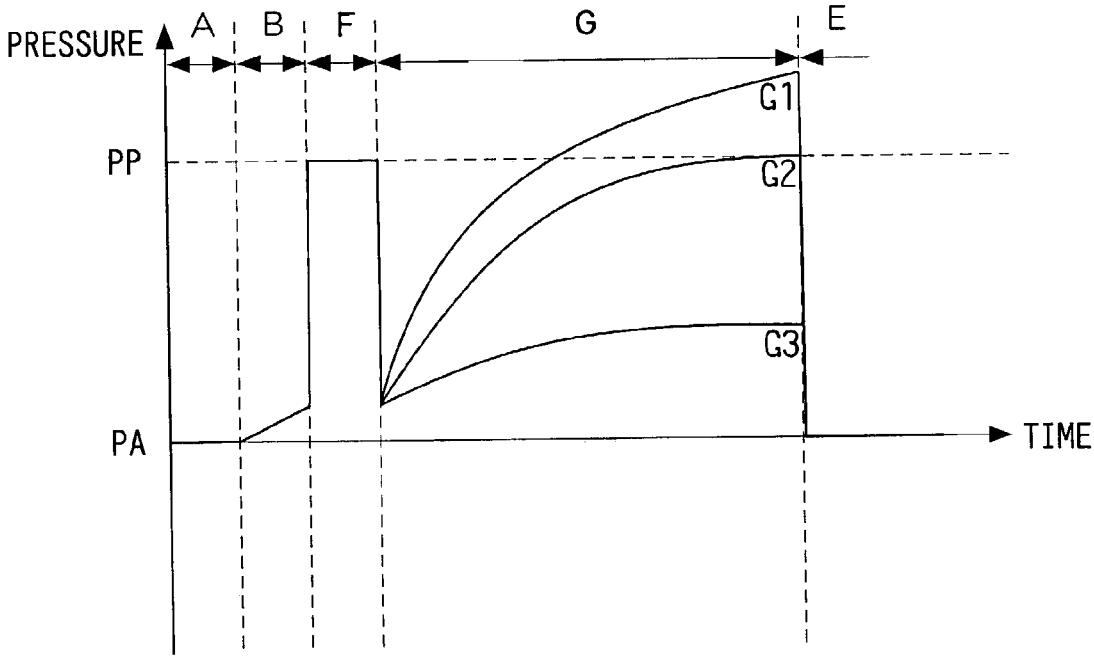
FIG. 9 is a timing chart showing pressure of a connection passage, according to the third embodiment of the present invention.

At first, the pressure sensor 13 detects the atmospheric pressure PA in step A as shown in FIG. 9, i.e., in the atmospheric pressure detection step. Then, the altitude of the vehicle having the detection system 1 is calculated by using the detected atmospheric pressure PA.

Then, the coil 61 of the switching device 30 is energized, in step B in FIG. 9, i.e., in the fuel vapor detection step. When the fuel in the fuel tank 2 evaporates so that the fuel vapor rises, the inner pressure of the fuel tank 2 becomes higher than the atmospheric pressure PA outside the fuel tank 2. In this case, the pressure of the air in the connection passage 43 increases, as shown by step B in FIG. 9.

After the pressure sensor 13 detects the pressure rising, the coil 61 stops to be energized, as shown by step F in FIG. 9, i.e., in the reference pressure detection step. The valve member 50 moves toward the second valve seat 33, so that the contact pad 52 is press-contacted to the second valve seat 33, as shown in FIG. 2. Thus, the tank passage 41 connects to the open passage 42, and both the tank passage 41 and the open passage 42 are connected to the connection passage 43 only through the orifice passage 45.

Then, the brushless motor 12 is energized so as to operate the pump 11 for pressurizing the connection passage 43. The mixed gas in the connection passage 43 flows into the valve chamber 22 through the orifice passage 45, and then the mixed gas flowing into the valve chamber 22 is released to the outside of the fuel tank 2 through the opening 42*a* of the open passage 42. However, the orifice 46 in the orifice passage 45 throttles flow of the mixed gas flowing into the valve chamber 22, so that the pressure in the connection passage 43 is increased to a predetermined pressure, i.e., a pressurizing reference pressure PP. Then, the pressure in the connection passage 43 is stabilized at the pressurizing reference pressure PP. Thus, the pressure sensor 13 detects the pressurizing reference pressure PP, and outputs a pressure signal to the ECU 4.

Then, the coil 61 of the switching device 30 is energized again, as shown by step G in FIG. 9. In step G, the washer 51 is press-contacted to the first valve seat 32, the tank passage 41 and the connection passage 43 are connected together, and the open passage 42 and the connection passage 43 are disconnected, as shown in FIG. 3. Thus, the fuel tank 2 connects to the connection passage 43 through the tank passage 41, so that the pressure of the fuel tank 2 becomes equal to that of the connection passage 43. Therefore, the pressure of the connection passage 43 decreases rapidly and temporarily. Then, the brushless motor 12 is energized to operate the pump 11 so that the inside air of the fuel tank 2 is pressurized. The controller 5 controls the brushless motor 12 so as to regulate a rotation speed of the brushless motor 12. Therefore, even when a pressure difference between the inside and outside of the fuel tank 2 is comparatively small, the detection system 1 can detect the evaporative emission leakage.

Here, because the fuel tank 2 connects to the connection passage 43, the pressure sensor 13 detects the pressure of the connection passage 43 that is equal to the pressure of the fuel tank 2. When the detected pressure of the connection passage 43, i.e., the pressure of the fuel tank 2, is increased above the pressurizing reference pressure PP, it is determined that the evaporative emission leakage from the fuel tank 2 is below the allowable amount, as shown by G1 in FIG. 9. This means that the inside air inside the fuel tank 2 is not released outside the fuel tank 2, so that the fuel tank 2 is airtight sufficiently. Therefore, the fuel vapor rising in the fuel tank 2 does not leak outside the fuel tank 2, and the evaporative emission leakage is below the allowable amount.

When the detected pressure of the connection passage 43 is almost equal to the pressurizing reference pressure PP, the evaporative emission leakage leaking from the fuel tank 2 corresponds to a leakage from the orifice 46, as shown by G2 in FIG. 9.

On the other hand, when the detected pressure of the connection passage 43 is not increased above the pressurizing reference pressure PP, it is determined that the evaporative fuel emission leakage exceeds the allowable amount, as shown by G3 in FIG. 9. In this case, the inside air inside the fuel tank 2 is released outside the fuel tank 2, as the fuel tank 2 is pressurized. Therefore, the fuel vapor rising in the fuel tank 2 leaks outside the fuel tank 2.

When the evaporative emission leakage is determined to exceed the allowable amount, the warning lamp (not shown) mounted on the instrument panel turns on when the engine starts at next time. A driver of the vehicle recognizes the warning lamp and is informed about the evaporative emission leakage.

After that, both the brushless motor 12 and the switching device 30 stop to be energized, as shown by step E in FIG. 9, i.e., in the detection completion step. The pressure of the connection passage 43 recovers to the atmospheric pressure PA. The pressure sensor 13 detects the atmospheric pressure PA and outputs the pressure signal to the ECU 4. Then, the ECU 4 controls the pressure sensor 13 to stop its operation. Then, the evaporation emission leak detection is completed.

In this embodiment, even when the mixed gas rising from the fuel tank 2 penetrates into the pump and the brushless motor 12, the brushless motor 12 is not abraded. Therefore, the life time of the brushless motor 12 will be lengthened.

Moreover, the accuracy of the evaporative emission leak detection by the pressure sensor 13 is improved because of the stable operation of the pump 11. Further, the detection accuracy of the leakage can be improved because of direct detection of the pressure of the fuel vapor.

Although the evaporative emission leak detection system 1 has the pressure sensor 13, the pressure sensor 13 can be eliminated. In this case, the ECU 4 gets the information about the operation characteristics of the brushless motor 12 from the controller 5, so that the inner pressure of the fuel tank 2 as well as the size of the leakage opnening can be calculated. Thus, the pressure of the connection passage 43 can be obtained indirectly by measuring the operation characteristics of the brushless motor 12 without the pressure sensor. Here, because the detection system 1 has no pressure sensor, the atmospheric pressure PA is obtained by another pressure sensor mounted on other equipment of the vehicle such as fuel injection equipment and air intake equipment.

(Modifications)

Although the evaporative emission leak detection system 1 has the orifice 46 for throttling the air flow, the orifice 46 can be eliminated. In this case, the absolute change of the pressure of the connection passage 43 or the absolute change of the operation characteristics of the brushless motor 12 is detected by the detection system 1 so that the evaporative emission leakage can be detected.

Although the brushless motor 12 is operated with constant voltage control, the brushless motor 12 can be operated with constant rotation speed control. In this case, the pressure difference between the inside and outside of the fuel tank 2 can be controlled at a predetermined difference that can be detected by the detection system 1. Moreover, the operation characteristics of the brushless motor 12 can be detected by measuring the rotation speed of the brushless motor 12. Besides, the brushless motor 12 can be operated with constant current control.

Such changes and modifications are to be understood as being within the scope of the present invention as defined by the appended claims.

What is claimed is:

1. An evaporative emission leak detection system for detecting a leakage of a fuel vapor evaporating in a fuel tank, the system comprising:

a pump for providing a pressure difference between an inside and outside of the fuel tank;

a brushless motor for operating the pump;

a first passage having an adsorbent for adsorbing the fuel vapor, the first passage connecting to the fuel tank;

a second passage connecting to the outside of the fuel tank;

a switching device for switching connections between the pump and at least one of the first passage and the second passage;

a detector disposed in a passage between the pump and the switching device for detecting a pressure; and a housing;

wherein the pump, the brushless motor, the switching device and the detector are accommodated in the housing.

2. The evaporative emission leak detection system according to claim 1, wherein the pump and the brushless motor are disposed in space, where the fuel vapor is filled.

3. The evaporative emission leak detection system according to claim 1, further comprising:

a throttle disposed between the second passage and the pump for throttling air flow at a predetermined amount.

4. The evaporative emission leak detection system according to claim 3, wherein the throttle provides an air flow corresponding to a leakage opening of 0.5 mm or less.

5. The evaporative emission leak detection system according to claim 1, wherein the pump depressurizes air in the fuel tank at least below the atmospheric pressure.

6. The evaporative emission leak detection system according to claim 1, wherein the brushless motor is operated with a constant rotation speed control.

7. The evaporative emission leak detection system according to claim 1, wherein the switching device is supplied with a holding electric power when the switching device maintains its operation, and the holding electric power is smaller than an electric power in a case where the switching device starts to operate.

8. The evaporative emission leak detection system according to claim 1, wherein the brushless motor is operated with a constant voltage control.

9. The evaporative emission leak detection system according to claim 1, wherein the brushless motor is operated with a constant current control.

10. The evaporative emission leak detection system according to claim 1, wherein the pump pressurizes air in the fuel tank at least above the atmospheric pressure.

11. The evaporative emission leak detection system according to claim 1, further comprising:

a throttle disposed between the second passage and the pump; and wherein the pump depressurizes air in the fuel tank at least below the atmospheric pressure, the throttle throttles air flow at a predetermined amount so that a pressure in a passage between the pump and the switching device is decreased to a reference pressure and is stabilized at the reference pressure when the first and second passages connect to the pump only through the throttle and the pump depressurizes the air in the passage, and the detector detects the atmospheric pressure, the fuel vapor pressure, and the reference pressure.

12. The evaporative emission leak detection system according to claim 11, further comprising:

a microcomputer for controlling the switching device, the detector, and the brushless motor, wherein the pressure in the passage between the pump and the switching device is decreased to a leak detection pressure when the fuel tank connects to the pump through the first passage and the pump depressurizes air in the fuel tank, and the microcomputer determines that the leakage of the fuel vapor exceeds the predetermined amount of the air flow limited by the throttle when the leak detection pressure becomes larger than the reference pressure.

13. The evaporative emission leak detection system according to claim 1, wherein the switching device is an electromagnetic valve.

14. An evaporative emission leak detection system for detecting a leakage of a fuel vapor evaporating in a fuel tank, the system comprising:

a pump for providing a pressure difference between an inside and outside of the fuel tank;

a brushless motor for operating the pump;

a first passage having an adsorbent for adsorbing the fuel vapor, the first passage connecting to the fuel tank;

a second passage connecting to the outside of the fuel tank;

an electromagnetic switching device for switching connections between the pump and at least one of the first passage and the second passage;

a housing; and a load detector for detecting a load of the brushless motor as an operation characteristic of the pump;

wherein the pump, the brushless motor and the electromagnetic switching device are accommodated in the housing.

15. The evaporative emission leak detection system according to claim 14, wherein the load detector detects current of the brushless motor or rotation speed of the brushless motor as the load of the brushless motor.

16. The evaporative emission leak detection system according to claim 14, wherein the load detector outputs information about the operation characteristic of the pump by using at least one of a voltage ratio signal, a duty ratio signal, and a bit output signal.

17. The evaporative emission leak detection system according to claim 14, wherein the electromagnetic switching device is an electromagnetic valve.

18. An evaporative emission leak detection system for detecting a leakage of a fuel vapor evaporating in a fuel tank, the system comprising:

a pump for providing a pressure difference between an inside and outside of the fuel tank;

a brushless motor for operating the pump;

a first passage having an adsorbent for adsorbing the fuel vapor, the first passage connecting to the fuel tank; and a second passage connecting to the outside of the fuel tank; and a switching device for switching connections between the pump and at least one of the first passage and the second passage;

wherein the pump and the brushless motor are disposed at a higher position than the fuel tank and the adsorbent.

19. A method of detecting a leakage of a fuel vapor evaporating in a fuel tank, the method comprising:

providing a pressure difference between an inside and outside of the fuel tank through operation of a pump;

operating the pump using a brushless motor;

adsorbing the fuel vapor with an adsorbent in a first passage connected to the fuel tank;

connecting a second passage to the outside of the fuel tank;

switching connections between the pump and at least one of the first passage and the second passage; and disposing the pump and the brushless motor at a higher position than the fuel tank and the adsorbent.

20. A method of detecting a leakage of a fuel vapor evaporating in a fuel tank, the method comprising:

providing a pressure difference between an inside and outside of the fuel tank through operation of a pump;

operating the pump using a brushless motor;

adsorbing the fuel vapor with an adsorbent in a first passage connected to the fuel tank;

connecting a second passage to the outside of the fuel tank;

switching connections between the pump and at least one of the first passage and the second passage;

detecting a pressure using a pressure detector in a passage between the pump and a switch that performs said switching;

detecting a load of the brushless motor as an operation characteristic of the pump; and arranging at least the brushless motor, the pressure detector and the pump in a housing.

21. The method according to claim 20, wherein the pump and the brushless motor are disposed in a space where the fuel vapor is filled.

22. The method according to claim 20, further comprising throttling air flow at a predetermined amount and at a position disposed between the second passage and the pump.

23. The method according to claim 20, wherein the pump depressurizes air in the fuel tank at least below the atmospheric pressure.

24. The method according to claim 20, further comprising operating the brushless motor with one of a constant rotation speed control, a constant voltage control and a constant current control.

25. The method according to claim 20, wherein said switching is accomplished through a switching device which is supplied with a holding electric power when the switching device maintains its operation, the holding electric power being smaller than an electric power in a case where the switching device starts to operate.

26. The method according to claim 20, wherein the pump pressurizes air in the fuel tank at least above the atmospheric pressure.

27. The method according to claim 20, further comprising:

disposing a throttle between the second passage and the pump; and disposing the pressure detector in the passage between the pump and a switching device which performs said switching;

wherein the pump depressurizes air in the fuel tank at least below the atmospheric pressure, the throttle throttles air flow at a predetermined amount so that a pressure in a passage between the pump and the switching device is decreased to a reference pressure and is stabilized at the reference pressure when the first and second passages connect to the pump only through the throttle and the pump depressurizes the air in the passage, and the pressure detector detects the atmospheric pressure, the fuel vapor pressure, and the reference pressure.

28. The method according to claim 27, further comprising:

decreasing the pressure in the passage between the pump and the switching device to a leak detection pressure when the fuel tank connects to the pump through the first passage and the pump depressurizes air in the fuel tank, and determining that the leakage of the fuel vapor exceeds the predetermined amount of the air flow limited by the throttle when the leak detection pressure becomes larger than the reference pressure.

29. The method according to claim 20, wherein the step of switching connections is performed by an electromagnetic valve.

30. An evaporative emission leak detection system for detecting a leakage of a fuel vapor evaporating in a fuel tank, the system comprising:

a pump for providing a pressure difference between an inside and outside of the fuel tank;

a motor for operating the pump;

a first passage having an adsorbent for adsorbing the fuel vapor, the first passage connecting to the fuel tank;

a second passage connecting to the outside of the fuel tank; and a switching device for switching connections between the pump and at least one of the first passage and the second passage;

wherein the pump and the motor are disposed at a higher position than the fuel tank and the adsorbent.

31. A method of detecting a leakage of a fuel vapor evaporating in a fuel tank, the method comprising:

providing a pressure difference between an inside and outside of the fuel tank through operation of a pump;

operating the pump using a motor;

adsorbing the fuel vapor with an adsorbent in a first passage connected to the fuel tank;

connecting a second passage to the outside of the fuel tank;

switching connections between the pump and at least one of the first passage and the second passage; and disposing the pump and the motor at a higher position than the fuel tank and the adsorbent.

* * * * *